US012135155B2

(12) United States Patent
Yamawaki et al.

(10) Patent No.: US 12,135,155 B2
(45) Date of Patent: Nov. 5, 2024

(54) TEMPERATURE CONTROL SYSTEM AND CONTROL METHOD OF TEMPERATURE CONTROL SYSTEM

(71) Applicant: SHINWA CONTROLS CO., LTD, Kawasaki (JP)

(72) Inventors: Masakatsu Yamawaki, Kawasaki (JP); Isamu Sasaki, Kawasaki (JP); Katsutoshi Sakai, Kawasaki (JP); Keisuke Sato, Kawasaki (JP)

(73) Assignee: Shinwa Controls Co., Ltd., Kawasaki (JP)

( * ) Notice: Subject to any disclaimer, the term of this patent is extended or adjusted under 35 U.S.C. 154(b) by 302 days.

(21) Appl. No.: 17/596,335

(22) PCT Filed: Aug. 6, 2021

(86) PCT No.: PCT/JP2021/029256
§ 371 (c)(1),
(2) Date: Dec. 8, 2021

(87) PCT Pub. No.: WO2022/059380
PCT Pub. Date: Mar. 24, 2022

(65) Prior Publication Data

US 2022/0307749 A1 Sep. 29, 2022

(30) Foreign Application Priority Data

Sep. 16, 2020 (JP) ..... 2020-155730

(51) Int. Cl.
*B25B 29/00* (2006.01)
*F25B 39/00* (2006.01)
(Continued)

(52) U.S. Cl.
CPC ..... *F25B 49/02* (2013.01); *F25B 39/00* (2013.01); *F25B 40/06* (2013.01);
(Continued)

(58) Field of Classification Search
CPC ..... F25B 49/02; F25B 39/00; F25B 40/06; F25B 2400/01; F25B 2600/21; F25B 2700/2103
(Continued)

(56) References Cited

FOREIGN PATENT DOCUMENTS

CN 110187726 A * 8/2019
JP 2009-058199 A 3/2009
(Continued)

OTHER PUBLICATIONS

English translation of the International Preliminary Report on Patentability (Chapter I) dated Mar. 30, 2023 (Application No. PCT/JP2021/029256).
(Continued)

*Primary Examiner* — Davis D Hwu
(74) *Attorney, Agent, or Firm* — BURR PATENT LAW, PLLC

(57) ABSTRACT

A temperature control system according to one embodiment includes: a refrigeration apparatus in which a compressor, a condenser, an expansion valve and an evaporator are connected in this order for circulating a refrigerant; a fluid circulation apparatus that causes a fluid to be heat-exchanged in the evaporator, then sends the fluid to a temperature control object, and again causes the fluid having passed through the temperature control object to be heat-exchanged in the evaporator, the fluid circulation apparatus having a heater at a position downstream of the temperature control object and upstream of the evaporator; and a control apparatus. The control apparatus activates the heater to heat the fluid by the heater, when the fluid circulation apparatus has become in a no-load operation state or a no-load-operation transition operation state, wherein the no-load operation state is a state in which the fluid and the temperature control object do not heat-exchange, the no-load-op-
(Continued)

eration transition operation state is a state that is in transition to the no-load operation state.

8 Claims, 4 Drawing Sheets

(51) Int. Cl.
*F25B 40/06* (2006.01)
*F25B 49/02* (2006.01)

(52) U.S. Cl.
CPC ..... *F25B 2400/01* (2013.01); *F25B 2600/21* (2013.01); *F25B 2700/2103* (2013.01)

(58) Field of Classification Search
USPC ..... 62/173
See application file for complete search history.

(56) References Cited

FOREIGN PATENT DOCUMENTS

| | | | |
|---|---|---|---|
| JP | 2009-058200 | A | 3/2009 |
| JP | 2011-163729 | A | 8/2011 |
| JP | 2014-145565 | A | 8/2014 |

OTHER PUBLICATIONS

International Search Report and Written Opinion (Application No. PCT/JP2021/029256) dated Sep. 21, 2021.
English translation of the International Search Report dated Sep. 21, 2021 (Application No. PCT/JP2021/029256).

* cited by examiner

TEMPERATURE CONTROL SYSTEM AND CONTROL METHOD OF TEMPERATURE CONTROL SYSTEM

TECHNICAL FIELD

The present invention relates to a temperature control system and control method of a temperature control system, in which a fluid circulated by a fluid circulation apparatus is cooled by a refrigeration apparatus, and the cooled fluid is used for temperature control.

BACKGROUND ART

A temperature control system is known, which comprises: a refrigeration apparatus having a compressor, a condenser, an expansion valve and an evaporator; and a fluid circulation apparatus that circulates fluid such as water, brine, etc., wherein the fluid circulated by the fluid circulation apparatus is cooled by the evaporator of the refrigeration apparatus (see, for example, JP2014-145565A).

DISCLOSURE OF THE INVENTION

The aforementioned temperature control system may be relatively large because it has both the refrigeration apparatus and the fluid circulation apparatus. However, such a system is desired to be compact in consideration of ease of transportation and decrease in space to be occupied. A refrigeration apparatus is generally provided with an accumulator for preventing liquid back. However, since an accumulator has relatively a large size, the accumulator is a factor that the system increasingly grows in size. Thus, if the liquid back can be suppressed without using such an accumulator, it will be advantageous in terms of compactness.

The present invention has been made in view of the above circumferences. An object of the present invention is to provide a temperature control system and a control method of a temperature control system, which can suitably suppress liquid back of a refrigerant in a refrigeration apparatus even when an accumulator having a reduced capacity is used or no accumulator is used.

A temperature control system (1) according to one embodiment of the present invention comprises:

a refrigeration apparatus in which a compressor, a condenser, an expansion valve and an evaporator are connected in this order for circulating a refrigerant;

a fluid circulation apparatus that causes a fluid to be heat-exchanged in the evaporator, then sends the fluid to a temperature control object, and again causes the fluid having passed through the temperature control object to be heat-exchanged in the evaporator, the fluid circulation apparatus having a heater at a position downstream of the temperature control object and upstream of the evaporator; and a control apparatus;

wherein the control apparatus activates the heater to heat the fluid by the heater, when the fluid circulation apparatus has become in a no-load operation state or a no-load-operation transition operation state, wherein the no-load operation state is a state in which the fluid and the temperature control object do not heat-exchange, the no-load-operation transition operation state is a state that is in transition to the no-load operation state.

In the temperature control system (1) according to the one embodiment, upon the no-load operation state or the no-load-operation transition operation state, a heating capacity Q for conforming a temperature of the fluid to be passed through the evaporator to a target temperature may be calculated from the following Equation (1):

$$Q=m\times Cp\times(Tt-Ts) \quad (1),$$

wherein a set temperature of the fluid to be supplied to the temperature control object is represented as Ts (° C.), the target temperature of the fluid, which flows downstream of the heater in the fluid circulation apparatus and does not yet pass through the evaporator, is represented as Tt (° C.), a weight flow rate at which the fluid circulation apparatus causes the fluid to flow is represented as m (kg/s), and a specific heat of the fluid is represented as Cp (J/kg° C.); and the control apparatus may control a heating capacity of the heater based on the heating capacity Q calculated from the Equation (1).

In the temperature control system (1) according to the one embodiment, when the control apparatus activates the heater upon the no-load operation state or the no-load-operation transition operation state, the control apparatus may control the heating capacity of the heater to be equal to or larger than the heating capacity Q calculated from the Equation (1).

When a temperature of the fluid, which flows downstream of the heater and does not yet pass through the evaporator, does not reach the target temperature after the heating capacity of the heater has been controlled to be equal to or larger than the heating capacity Q calculated from the Equation (1), the control apparatus may regulate the heater.

When the heating capacity Q calculated from the Equation (1) exceeds a maximum heating capacity of the heater, the control apparatus may control the heater at the maximum heating capacity.

In the temperature control system (1) according to the one embodiment, when a temperature of the fluid, which has passed through the temperature control object and flows upstream of the heater, becomes lower than a predetermined temperature, the control apparatus may determine that the fluid circulation apparatus has become in the no-load operation state or the no-load-operation transition operation state.

In addition, a temperature control system (2) according to one embodiment of the present invention comprises:

a refrigeration apparatus in which a compressor, a condenser, an expansion valve and an evaporator are connected in this order for circulating a refrigerant;

a fluid circulation apparatus that causes a fluid to be heat-exchanged in the evaporator, then sends the fluid to a temperature control object, and again causes the fluid having passed through the temperature control object to be heat-exchanged in the evaporator, the fluid circulation apparatus having a heater at a position downstream of the temperature control object and upstream of the evaporator; and a control apparatus;

wherein the control apparatus activates the heater to heat the fluid by the heater, when a return temperature of the fluid, which flows downstream of the heater in the fluid circulation apparatus and does not yet pass through the evaporator, is lower than a target temperature.

In the temperature control system (2) according to the one embodiment, a return temperature is represented as Tb (° C.), a target temperature is represented as Tt (° C.), a weight flow rate at which the fluid circulation apparatus causes the fluid to flow is represented as m (kg/s), and a specific heat of the fluid is represented as Cp (J/kg° C.). When the return temperature Tb is lower than the target temperature Tt, the control apparatus may control the heater for conforming the return temperature Tb to the target temperature Tt by feedback control based on a difference between the return temperature Tb and the target temperature Tt.

At this time, the control apparatus may calculate a heating capacity Q for conforming the return temperature Tb to the target temperature Tt from the following Equation (2):

$$Q=m\times Cp\times(Tt-Tb) \quad (2), \text{ and}$$

the control apparatus may control a heating capacity of the heater based on the heating capacity Q calculated from the Equation (2).

In the temperature control system (2) according to the one embodiment, when the return temperature Tb becomes lower than the target temperature Tt and the heater is activated, the control apparatus may control the heating capacity of the heater to be equal to or larger than the heating capacity Q calculated from the Equation (2).

When the heating capacity Q calculated from the Equation (2) exceeds a maximum heating capacity of the heater, the control apparatus may control the heater at the maximum heating capacity.

In the temperature control system (1)/(2) according to the one embodiment, the refrigeration apparatus may have no accumulator.

The target temperature may be set in a temperature range by which the refrigerant, which has heat-exchanged with the fluid and flows out from the evaporator, becomes superheated vapor.

In addition, a control method of a temperature control system according to one embodiment, the temperature control system comprising: a refrigeration apparatus in which a compressor, a condenser, an expansion valve and an evaporator are connected in this order for circulating a refrigerant; and a fluid circulation apparatus that causes a fluid to be heat-exchanged in the evaporator, then sends the fluid to a temperature control object, and again causes the fluid having passed through the temperature control object to be heat-exchanged in the evaporator, the fluid circulation apparatus having a heater at a position downstream of the temperature control object and upstream of the evaporator;

the control method comprises the steps of:

determining whether the fluid circulation apparatus has become in a no-load operation state or a no-load-operation transition operation state, wherein the no-load operation state is a state in which the fluid and the temperature control object do not heat-exchange, the no-load-operation transition operation state is a state that is in transition to the no-load operation state; and activating the heater to heat the fluid by the heater, upon determination of the no-load operation state or the no-load-operation transition operation state.

A control method of a temperature control system according to another embodiment, the temperature control system comprising: a refrigeration apparatus in which a compressor, a condenser, an expansion valve and an evaporator are connected in this order for circulating a refrigerant; and a fluid circulation apparatus that causes a fluid to be heat-exchanged in the evaporator, then sends the fluid to a temperature control object, and again causes the fluid having passed through the temperature control object to be heat-exchanged in the evaporator, the fluid circulation apparatus having a heater at a position downstream of the temperature control object and upstream of the evaporator;

the control method comprising the steps of:

determining whether a return temperature of the fluid, which flows downstream of the heater in the fluid circulation apparatus and does not yet pass through the evaporator, is lower than a target temperature; and activating the heater to heat the fluid by the heater, upon determination that the return temperature is lower than the target temperature.

The present invention can suitably suppress liquid back of a refrigerant in a refrigeration apparatus even when an accumulator having a reduced capacity is used or no accumulator is used.

MODE FOR CARRYING OUT THE INVENTION

Respective embodiments of the present invention will be described here below.

First Embodiment

Figure 1:
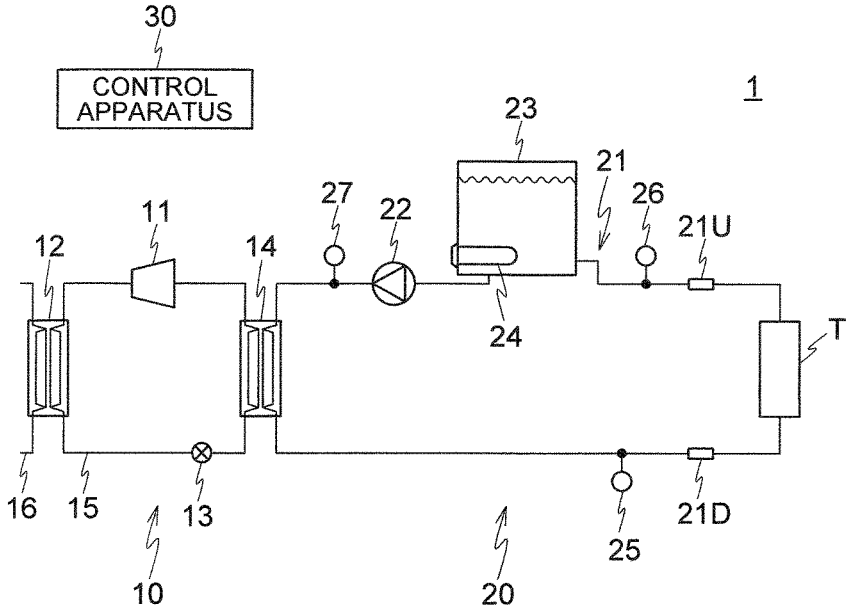
FIG. 1 is a view showing a schematic structure of a temperature control system according to a first embodiment of the present invention.

FIG. 1 is a schematic view of a temperature control system 1 according to a first embodiment of the present invention. The temperature control system 1 shown in FIG. 1 comprises a refrigeration apparatus 10, a fluid circulation apparatus 20, and a control apparatus 30.

The refrigeration apparatus 10 controls a temperature of a fluid made to flow by the fluid circulation apparatus 20 by means of a refrigerant. The fluid circulation apparatus 20 supplies a temperature control object T with the fluid which is controlled in temperature by the refrigeration apparatus 10.

The fluid circulation apparatus 20 circulates the fluid having passed through the temperature control object T. Then, the fluid returned from the temperature control object T is again controlled in temperature by the refrigeration apparatus 10. The fluid circulated by the fluid circulation apparatus 20 is brine, for example, but may be another fluid such as water.

The control apparatus 30 is configured to control the refrigeration apparatus 10 and the fluid circulation apparatus 20. For example, the control apparatus 30 sets a temperature of the fluid to be supplied to the temperature control object T in response to a user's operation, and controls the respective components such that the fluid has become the set temperature. The respective components of the temperature control system 1 are described in detail here below.

The refrigeration apparatus 10 is composed of a compressor 11, a condenser 12, an expansion valve 13 and an evaporator 14 which are connected in this order by a pipe 15 to circulate a refrigerant therethrough. Note that the refrigeration apparatus 10 in this embodiment has no accumulator. However, the refrigeration apparatus 10 may haven an accumulator.

The compressor 11 compresses a low-temperature and low-pressure gaseous refrigerant flowing out from the evaporator 14, into the high-temperature and high-pressure gaseous refrigerant, and supplies it to the condenser 12. The condenser 12 cools and condenses the refrigerant compressed by the compressor 11, by means of a cooling water, into the high-pressure liquid refrigerant having a predetermined cooled temperature, and supplies it to the expansion valve 13. Water or another refrigerant can be used as the cooling water of the condenser 12. The symbol 16 in FIG. 1 indicates a cooling water pipe for supplying cooling water to the condenser 12. The condenser 12 may be of an air-cooled type.

The expansion valve 13 expands to decompress the refrigerant supplied from the condenser 12 into the low-temperature and low-pressure refrigerant in a gas-liquid mixture state, and supplies it to the evaporator 14. The evaporator 14 causes the refrigerant supplied from the expansion value 13 to heat-exchange with a fluid of the fluid circulation apparatus 20. The refrigerant that has heat-exchanged with the fluid becomes a low-temperature and low-pressure gaseous state, and flows out from the evaporator 14 into the compressor 11, and is again compressed by the compressor 11.

The fluid circulation apparatus 20 comprises a main flow pipe 21 having a return port 21U and a supply port 21D, and is connected to the temperature control object T through flow pipes connected to the return port 21U and the supply port 21D, respectively. The main flow pipe 21 of the fluid circulation apparatus 20 is connected to the evaporator 14. The fluid circulation apparatus 20 causes the fluid which flows through the main flow pipe 21 to be heat-exchanged in the evaporator, and sends it to the temperature control object T. Then, the fluid circulation apparatus 20 again causes the fluid having passed through the temperature control object T to be heat-exchanged in the evaporator 14.

The fluid circulation apparatus 20 also has a pump 22, a tank 23, a heater 24 and first to third temperature sensors 25 to 27, which are provided on the main flow pipe 21.

The pump 22 forms a part of the main flow pipe 21 and generates a driving force for causing the fluid to flow. The pump 22 is located upstream of a position where the main flow pipe 21 is connected to the evaporator 14, but its position is not particularly limited.

The tank 23 and the heater 24 are located upstream of the position where the main flow pipe 21 is connected to the evaporator 14. Namely, in the fluid circulation apparatus 20 connected to the temperature control object T, the tank 23 and the heater 24 are located downstream of the temperature control object T and upstream of the evaporator 14.

The tank 23 is provided for storing a certain amount of fluid, and forms a part of the main flow pipe 21. The heater 24 is provided for heating the fluid. In this embodiment, the heater 24 is located in the tank 23, but the heater 24 may be provided outside the tank 23. The heater 24 is electrically connected to the control apparatus 30 so that its heating capacity is controlled by the control apparatus 30.

The first temperature sensor 25 detects a temperature of the fluid which flows downstream of position where the main flow pipe 21 is connected to the evaporator 14, the second temperature sensor 26 detects a temperature of the fluid which has passed through the temperature control object T and flows upstream of the heater 24. In more detail, the second temperature sensor 26 detects a temperature of the fluid which has passed through the temperature control object T to flow upstream of the heater 24 and does not yet flow into the tank 23.

The third temperature sensor 27 detects a temperature of the fluid which flows downstream of the heater 24 in the fluid circulation apparatus 20 and does not yet pass through the evaporator 14.

The first to third temperature sensors 25 to 27 are electrically connected to the control apparatus 30, and information of temperatures detected by them is transmitted to the control apparatus 30.

The control apparatus 30 is a controller that controls operations of the refrigeration apparatus 10 and the fluid circulation apparatus 20, and may comprise, for example, a computer having a CPU, a ROM, etc. In this case, the control apparatus 30 performs various processes based on a program stored in the ROM. The control apparatus 30 may also comprise another processor and an electric circuit (e.g., FPGA (Field Programmable Gate Alley), etc.).

Figure 2:
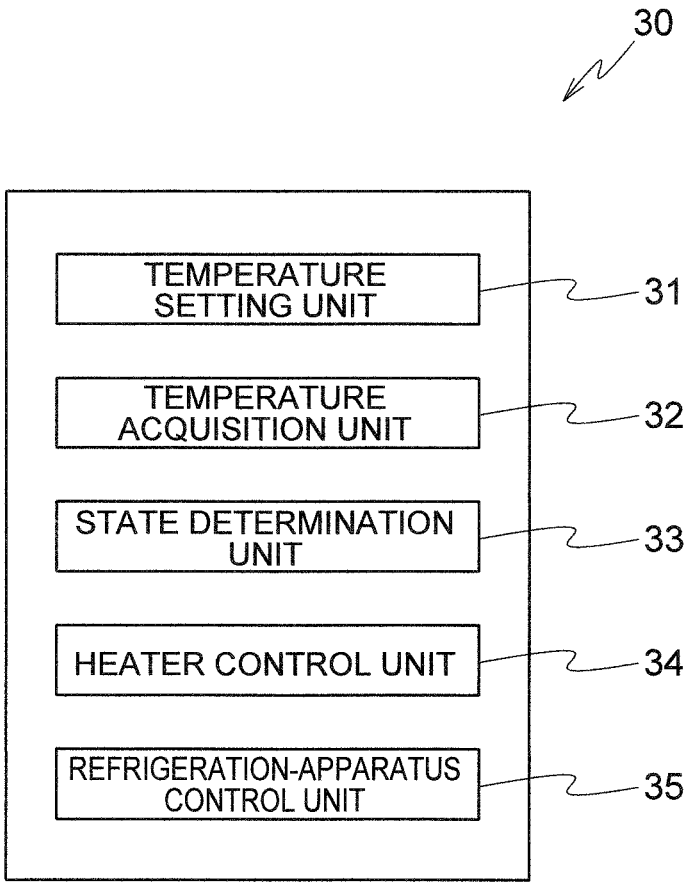
FIG. 2 is a block diagram showing functional structures of a control apparatus forming the temperature control system according to the first embodiment.

FIG. 2 is a block diagram showing functional structures of the control apparatus 31 forming the temperature control system according to the first embodiment. As showing in FIG. 2, the control apparatus 31 has a temperature setting unit 31, a temperature acquisition unit 32, a state determination unit 33, a heater control unit 34, and a refrigeration-apparatus control unit 35. These functional structures are realized by executing a program, for example.

The temperature setting unit 31 sets, as a set temperature, a temperature of the fluid to be supplied to the temperature control object T and holds (records) the temperature, in response to a user's operation. The temperature setting unit 31 also sets a target temperature of a return temperature of the fluid, which flows downstream of the heater 24 and does not yet pass though the evaporator 14, and holds (records) the temperature, in response to a user's operation.

The aforementioned target temperature is set in a temperature range by which the refrigerant, which has heat-exchanged with the fluid of the fluid circulation apparatus 20 and flows out from the evaporator 14, becomes superheated vapor. When the return temperature of the fluid, which flows downstream of the heater 24 and does not yet pass through the evaporator 14, becomes equal to or larger than such a target temperature, there is no risk that the refrigerant containing a liquid phase returns to the compressor 11. Namely, liquid back can be avoided.

The temperature acquisition unit 32 acquires the temperature information detected by the first to third temperature sensors 25 to 27. The temperature acquisition unit 32 transmits the temperature information acquired from the first to third temperature sensors 25 to 27 to the state determination unit 33, the heater control unit 34 and the refrigeration-apparatus control unit 35.

The state determination unit 33 determines a state of the fluid circulation apparatus 20 based on the temperature information detected by the first to third temperature sensors 25 to 27.

In this embodiment, the status determination unit 33 determines whether the fluid circulation apparatus 20 has become in a no-load operation state or a no-load-operation transition operation state which is in transition to the no-load operation state, based on the temperature information detected by the second sensor 26. In more detail, the state determination unit 33 determines whether a temperature of the fluid, which has passed through the temperature control object T and flows upstream of the heater 24, becomes lower than a predetermined temperature. If yes, the state determination unit 33 determines that the fluid circulation apparatus 20 has become in the no-load operation state or the no-load-operation transition operation state.

The no-load operation state means that the temperature control object T does not heat-exchange with the fluid. The no-load-operation transition operation state means a state that is in transition to the no-load operation state, in which the temperature control object T less heat-exchanges with the fluid than usual.

For example, a case where the temperature control object T is a device that generates heat is considered. In the normal operation of the fluid circulation apparatus 20, after the temperature controlled fluid has heat-exchanged with the temperature control object T and has passed through the temperature control object T, the fluid has a higher temperature before the heat exchange. On the other hand, when the temperature control object T as the heat generation apparatus is stopped so that the heat generated by it gradually decreases, the temperature control object T less heat-exchanges with the fluid than the case of the normal operation. Finally, the temperature control object T does not heat-exchange with the fluid at all.

Namely, the no-load-operation transition operation state means a state in which the temperature control object T as the heat generation apparatus is stopped, for example, whereby the temperature control object T less heat-exchanges with the fluid than the usual case. On the other hand, the no-load operation state means a state in which, after the temperature control object T as the heat generation apparatus has been stopped, for example, the temperature control object T substantially does not heat-exchange with the fluid.

The aforementioned predetermined temperature based on which whether the fluid circulation apparatus 20 has become in the no-load operation state or the no-load-operation transition operation state is determined is a temperature equal to or higher than the set temperature of the fluid to be supplied to the temperature control object T, for example. The predetermined temperature is suitably selected in relation to a temperature of the temperature control object T.

The state determination unit 33 in this embodiment determines whether a return temperature of the fluid, which flows downstream of the heater 24 and does not yet pass through the evaporator 14, is lower than the aforementioned target temperature, based on the temperature information detected by the third temperature sensor 27. If yes, the state determination unit 33 generates a liquid back risk signal. When such a liquid back risk signal is generated, a warning may be issued.

The heater control unit 34 activates the heater 24 to heat the fluid by the heater 24, when the state determination unit 33 determines that the fluid circulation apparatus 20 has become in the no-load operation state/no-load-operation transition operation.

The refrigeration-apparatus control unit 35 compares the set temperature of the fluid to be supplied to the temperature control object T, which is set by the temperature setting unit 31, and a detection temperature based on the first temperature sensor 25, and controls the respective components of the refrigeration apparatus 10 in such a manner that the detection temperature detected by the first temperature sensor 25 conforms to the set temperature. The set temperature may be set to, for example, 10° C., 0° C., −10° C., etc. For example, the refrigeration-apparatus control unit 35 regulates an evaporation pressure in the evaporator 14 by increasing or decreasing a rotation speed of the compressor 11 in the refrigeration apparatus 10 in accordance with such a set temperature, so as to regulate the fluid temperature to the set temperature.

The heater control unit 34 is described in detail below. As described above, the heater control unit 34 activates the heater 24, when the fluid circulation apparatus 20 has become in the no-load operation state or the no-load-operation transition operation state. Thereafter, the heater control unit 34 controls a heating capacity of the heater 24.

In the control of the heating capacity of the heater 24, the control apparatus 30 in this embodiment causes the heater control unit 34 to calculate, from the following Equation (1), a heating capacity Q for conforming a temperature of the fluid to be passed through the evaporator 14 to a target temperature Tt.

$$Q=m\times Cp\times(Tt-Ts) \quad (1),$$

wherein the set temperature of the fluid to be supplied to the temperature control object T is represented as Ts (° C.), the target temperature of the fluid, which flows downstream of the heater 24 in the fluid circulation apparatus 20 and does not yet pass through the evaporator 14, is represented as Tt (° C.), a weight flow rate at which the fluid circulation apparatus 20 causes the fluid to flow is represented as m (kg/s), and a specific heat of the fluid is represented as Cp (J/kg° C.). The set temperature Ts and the target temperature Tt are set by the temperature setting unit 31. The weight flow rate m may be detected by a flow rate sensor or specified from a state of the pump 22. The specific heat Cp of the fluid is held (stored) by the control apparatus 30 in advance.

Then, the control apparatus 30 controls a heating capacity of the heater 24 based on the heating capacity Q calculated by the heater control unit 34 based on the Equation (1). Specifically, the heater control unit 34 controls the heating capacity of the heater 24 to be equal to or larger than the heating capacity Q calculated from the Equation (1). This heating capacity, which is a control target value, may be determined in advance based on the heating capacity Q previously calculated from the Equation (1), and may be stored in the control apparatus 30 in advance.

There is a possibility that the heating capacity Q calculated from the Equation (1) exceeds a maximum heating capacity of the heater 24. In this case, the control apparatus 30 controls the heater 24 at the maximum heating capacity.

As described above, in this embodiment, the heating capacity of the heater 24 is controlled to be equal to or larger than the heating capacity Q calculated from the Equation (1). However, the heater 24 may be controlled such that its heating capacity becomes just equal to the heating capacity Q calculated from the Equation (1). When the heating capacity of the heater 24 is controlled to be equal to or larger than the heating capacity Q calculated from the Equation (1), it is desirable that the heating capacity is set to have a value that is not excessively larger than the heating capacity Q (e.g., 2Q or less).

The reason for activating the heater 24 when the fluid circulation apparatus 20 has become in the no-load operation state or the no-load-operation transition operation state is to avoid the fluid from passing through the evaporator 14 at a low temperature. In this case, evaporation of the refrigerant in the refrigeration apparatus 10 becomes insufficient, which results in liquid back. The larger the heating capacity of the heart 24 is, the lower the risk of liquid back becomes. However, an excessively large heating capacity of the heater 24 may cause inconveniences such as seizure (seize) of the compressor 11. Thus, an excessively large heating capacity of the heater 24 is undesirable.

In addition, when a temperature of the fluid, which flows downstream of the heater 24 and does not yet pass through the evaporator 14, does not reach the target temperature Tt after the heating capacity of the heater 24 has been controlled to be equal to or larger than the heating capacity Q calculated from the Equation (1), the control apparatus 30 may regulate the heater 24.

Namely, after the heating capacity of the heater 24 has been controlled, it is determined whether a return temperature of the fluid, which flows downstream of the heater 24 and does not yet pass through the evaporator 14, is lower than the aforementioned target temperature, based on the temperature information detected by the third temperature sensor 27. When a liquid back risk signal is generated based on the determination, the heater 24 may be regulated. At this time, a warning may be issued simultaneously with the regulation of the heater 24.

Figure 3:
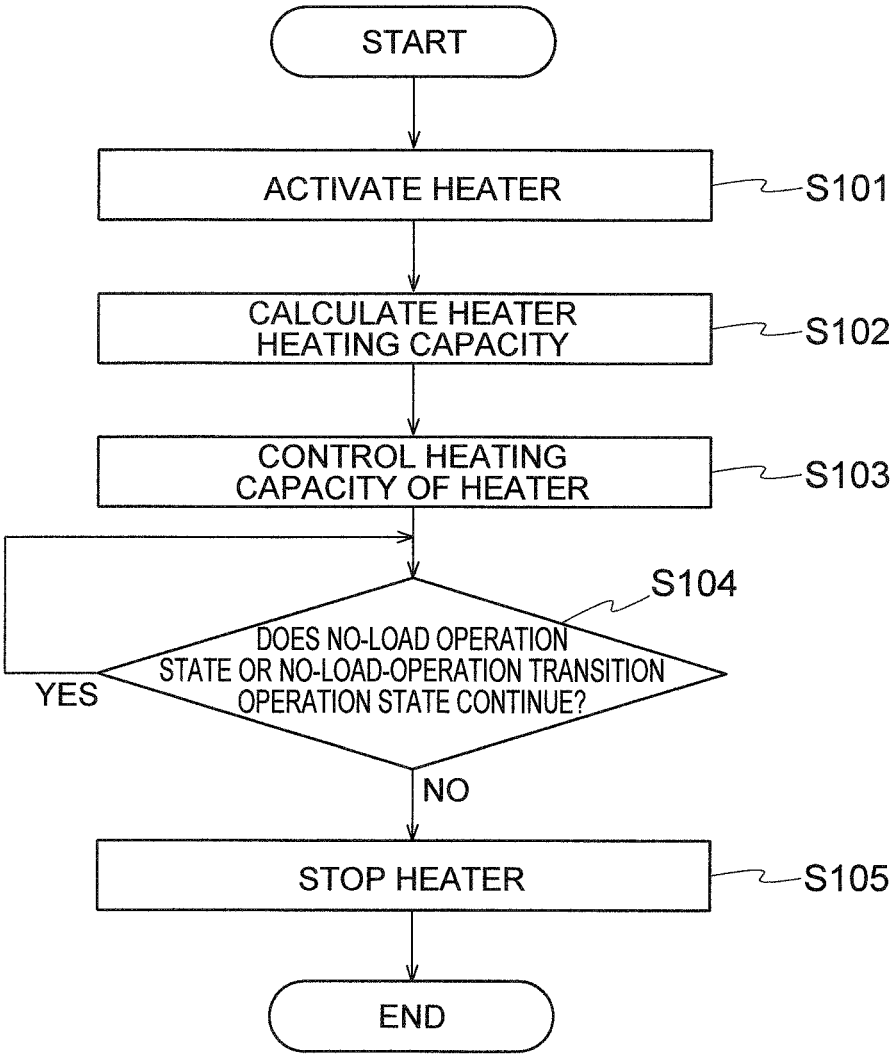
FIG. 3 is a flowchart describing an example of an operation of a control apparatus forming the temperature control system according to the first embodiment.

FIG. 3 is a flowchart describing an example of an operation of the control apparatus 30. An example of the operation of the control apparatus 30 (heater control unit 34) is described with reference to FIG. 3.

The operation shown in FIG. 3 is started when the state determination unit 33 determines that the fluid circulation apparatus 20 has become in the no-load operation state or the no-load-operation transition operation. Upon start of the operation, in a step S101, the heater control unit 34 activates the heater 24 first.

Then, in a step S102, the heater control unit 34 calculates the heating capacity Q for conforming a temperature of the fluid to be passed through the evaporator 14 to the target temperature Tt in accordance with the aforementioned Equation (1).

Then, in a step S103, the heater control unit 34 controls the heating capacity of the heater 24 based on the heating capacity Q calculated from the Equation (1). Specifically, the heater 24 is controlled such that its heating capacity becomes equal to or larger than the heating capacity Q.

Then, in a step S104, the state determination unit 33 monitors whether the no-load operation state or the no-load-operation transition operation state continues. When the no-load operation state or the no-load-operation transition operation continues, the monitoring is repeated. On the other hand, when it is determined that the no-load operation state or the no-load-operation transition operation state has exited, in a step S105, the heater control unit 34 stops the heater 24, and the operation ends.

Whether the no-load operation state or the no-load-operation transition operation state has exited can be determined by a detection in which a temperature of the fluid, which has passed through the temperature control object T and flows upstream of the heater 24, has become equal to or larger than a predetermined temperature, based on the temperature information detected by the second temperature sensor 26.

In the embodiment as described above, upon determination of the no-load operation state/no-load-operation transition operation, the control apparatus 30 activates the heater 24 by the heater control unit 34. In this case, the fluid can be avoided from passing through the evaporator 14 at a low temperature so that evaporation of the refrigerant in the refrigeration apparatus 10 becomes insufficient, which results in liquid back. Thus, even when an accumulator having a reduced capacity is used or no accumulator is used, liquid back of the refrigerant in the refrigeration apparatus can be suitably suppressed. As a result, the temperature control system 1 can be easily made compact.

Second Embodiment

Next, a second embodiment is described. The second embodiment differs from the first embodiment in the operation of the heater control unit 34 in the control apparatus 30. Other structures are identical to those of the first embodiment.

In detail, the control apparatus 30 in the second embodiment activates the heater 24 by the heater control unit 34 to heat the fluid by the heater 24, when a return temperature of the fluid, which flows downstream of the heater 24 and does not yet pass through the evaporator 14, is lower than the target temperature set by the temperature setting unit 31. Namely, when the liquid back risk signal described in the first embodiment is generated, the heater control unit 34 activates the heater 24.

At this time, a heating capacity Q for conforming the return temperature Tb to the target temperature Tt is calculated from the following Equation (2):

$$Q=m\times Cp\times(Tt-Tb) \quad (2),$$

wherein the return temperature is represented as Tb (° C.), the target temperature is represented as Tt (° C.), a weight flow rate at which the fluid circulation apparatus 20 causes the fluid to flow is represented as m (kg/s), and a specific heat of the fluid is represented as Cp (J/kg° C.).

Then, the control apparatus 30 controls the heating capacity of the heater 24 based on the heating capacity Q calculated by the heater control unit 34 based on the Equation (2). At this time, the heater control unit 34 controls the heating capacity of the heater 24 to be equal to or larger than the heating capacity Q calculated from the Equation (2). Such control of the heating capacity is performed each time when it is detected that the return temperature of the fluid, which flows downstream of the heater 24 and does not yet pass through the evaporator, is lower than the target temperature set by the temperature setting unit 31. Namely, the heater 24 is controlled by feedback control based on a difference between the return temperature Tb and the target temperature Tt for conforming them to each other. However, the heating capacity control of the heater 24 is not limited to this type of control.

Figure 4:
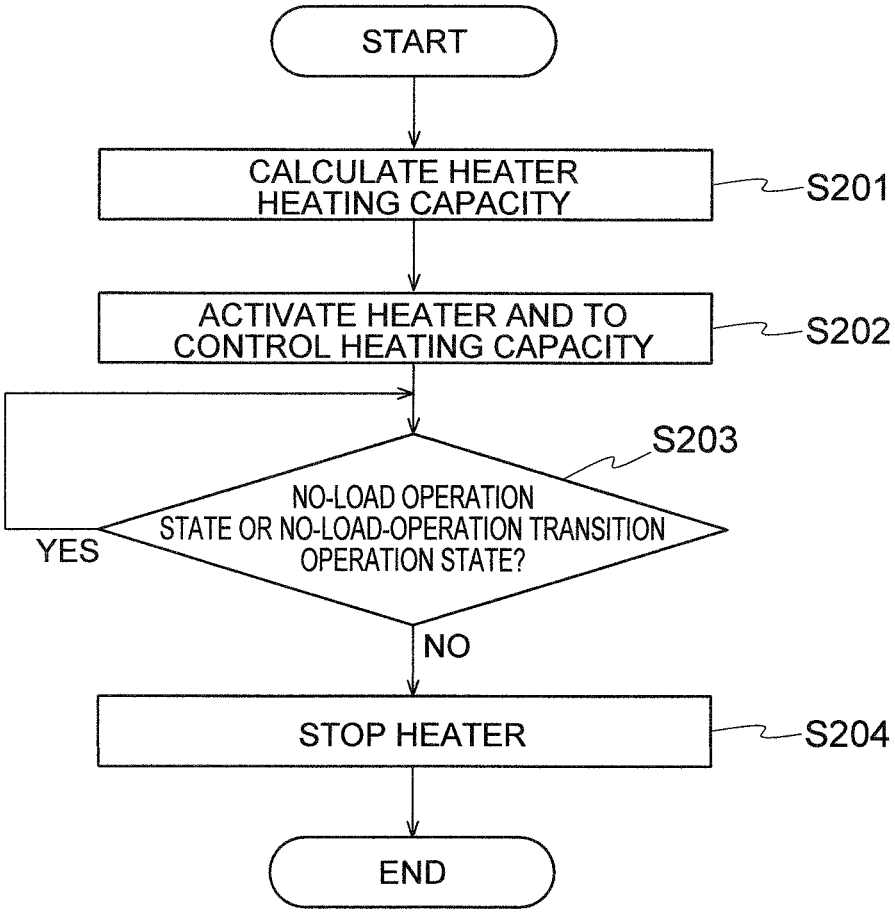
FIG. 4 is a flowchart describing an example of an operation of a control apparatus forming a temperature control system according to a second embodiment.

FIG. 4 is a flowchart flowchart describing an example of a operation of the control apparatus 30 in the second embodiment. An example of the operation of the control apparatus 30 (heater control unit 34) is described with reference to FIG. 4.

The operation shown in FIG. 4 is started when a liquid back risk signal is generated. Upon start of the operation, in a step S201, the heater control unit 34 calculates the heating capacity Q for conforming a return temperature Tb to the target temperature Tt in accordance with the aforementioned Equation (2).

Then, in a step S202, the heater control unit 34 controls the heating capacity of the heater 24 based on the heating capacity Q calculated from the Equation (2). Specifically, the heater 24 is controlled such that its heating capacity becomes equal to or larger than the calculated heating capacity Q.

Then, in a step S203, the state determination unit 33 determines whether the fluid circulation apparatus 20 has become in the no-load operation state or the no-load-operation transition operation. Upon determination of the no-load operation state/no-load-operation transition operation state, the determination process is repeated. On the other hand, upon determination of not in the no-load operation state or the no-load-operation transition operation state, in a step 204, the heater control unit 34 stops the heater 24, and the operation ends.

Also due to such a second embodiment, the fluid can be avoided from passing through the evaporator 14 at a low temperature so that evaporation of the refrigerant in the refrigeration apparatus 10 becomes insufficient, which results in liquid back. Thus, even when an accumulator having a reduced capacity is used or no accumulator is used, liquid back of the refrigerant in the refrigeration apparatus can be suitably suppressed. As a result, the temperature control system 1 can be easily made compact.

The present invention is not limited to the aforementioned embodiments, and the above embodiments can be variously modified.

The invention claimed is:

1. A temperature control system comprising:

a refrigeration apparatus in which a compressor, a condenser, an expansion valve and an evaporator are connected in this order for circulating a refrigerant;

a fluid circulation apparatus that causes a fluid to be heat-exchanged in the evaporator, then sends the fluid to a temperature control object, and again causes the fluid having passed through the temperature control object to be heat-exchanged in the evaporator, the fluid circulation apparatus having a heater at a position downstream of the temperature control object and upstream of the evaporator; and a control apparatus;

wherein the control apparatus activates the heater to heat the fluid by the heater, when the fluid circulation apparatus has become in a no-load operation state or a no-load-operation transition operation state, wherein the no-load operation state is a state in which the fluid and the temperature control object do not heat-exchange, the no-load-operation transition operation state is a state that is in transition to the no-load operation state, wherein upon the no-load operation state or the no-load-operation transition operation state, a heating capacity Q for conforming a temperature of the fluid to be passed through the evaporator to a target temperature is calculated from the following Equation (1):

$$Q=m\times Cp\times(Tt-Ts) \quad (1),$$

wherein a set temperature of the fluid to be supplied to the temperature control object is represented as Ts (° C.), the target temperature of the fluid, which flows downstream of the heater in the fluid circulation apparatus and does not yet pass through the evaporator, is represented as Tt (° C.), a weight flow rate at which the fluid circulation apparatus causes the fluid to flow is represented as m (kg/s), and a specific heat of the fluid is represented as Cp (J/kg° C.); and the control apparatus controls a heating capacity of the heater based on the heating capacity Q calculated from the Equation (1).

2. The temperature control system according to claim 1, wherein, when the control apparatus activates the heater upon the no-load operation state or the no-load-operation transition operation state, the control apparatus controls the heating capacity of the heater to be equal to or larger than the heating capacity Q calculated from the Equation (1).

3. The temperature control system according to claim 2, wherein, when a temperature of the fluid, which flows downstream of the heater and does not yet pass through the evaporator, does not reach the target temperature after the heating capacity of the heater has been controlled to be equal to or larger than the heating capacity Q calculated from the Equation (1), the control apparatus regulates the heater.

4. The temperature control system according to claim 1, wherein, when the heating capacity Q calculated from the Equation (1) exceeds a maximum heating capacity of the heater, the control apparatus controls the heater at the maximum heating capacity.

5. The temperature control system according to claim 1, wherein, when a temperature of the fluid, which has passed through the temperature control object and flows upstream of the heater, becomes lower than a predetermined temperature, the control apparatus determines that the fluid circulation apparatus has become in the no-load operation state or the no-load-operation transition operation state.

6. The temperature control system according to claim 1, wherein the refrigeration apparatus has no accumulator.

7. The temperature control system according to claim 1, wherein the target temperature is set in a temperature range by which the refrigerant, which has heat-exchanged with the fluid and flows out from the evaporator, becomes superheated vapor.

8. A control method of a temperature control system comprising: a refrigeration apparatus in which a compressor, a condenser, an expansion valve and an evaporator are connected in this order for circulating a refrigerant; and a fluid circulation apparatus that causes a fluid to be heat-exchanged in the evaporator, then sends the fluid to a temperature control object, and again causes the fluid having passed through the temperature control object to be heat-exchanged in the evaporator, the fluid circulation apparatus having a heater at a position downstream of the temperature control object and upstream of the evaporator;

the control method comprising the steps of:

determining whether the fluid circulation apparatus has become in a no-load operation state or a no-load-operation transition operation state, wherein the no-load operation state is a state in which the fluid and the temperature control object do not heat-exchange, the no-load-operation transition operation state is a state that is in transition to the no-load operation state; and activating the heater to heat the fluid by the heater, upon determination of the no-load operation state/no-load-operation transition operation state, wherein upon the no-load operation state or the no-load-operation transition operation state, a heating capacity Q for conforming a temperature of the fluid to be passed through the evaporator to a target temperature is calculated from the following Equation (1):

$$Q=m\times Cp\times(Tt-Ts) \quad (1),$$

wherein a set temperature of the fluid to be supplied to the temperature control object is represented as Ts (° C.), the target temperature of the fluid, which flows downstream of the heater in the fluid circulation apparatus and does not yet pass through the evaporator, is represented as Tt (° C.), a weight flow rate at which the fluid circulation apparatus causes the fluid to flow is represented as m (kg/s), and a specific heat of the fluid is represented as Cp (J/kg° C.); and a heating capacity of the heater is controlled based on the heating capacity Q calculated from the Equation (1).

* * * * *